US007757789B2

(12) United States Patent
Yong et al.

(10) Patent No.: US 7,757,789 B2
(45) Date of Patent: Jul. 20, 2010

(54) DRILL BIT AND INSERT HAVING BLADED INTERFACE BETWEEN SUBSTRATE AND COATING

(75) Inventors: Zhou Yong, Spring, TX (US); Jiaqing Yu, Houston, TX (US); Chris A. Tucker, Provo, UT (US)

(73) Assignee: Smith International, Inc., Houston, TX (US)

( * ) Notice: Subject to any disclaimer, the term of this patent is extended or adjusted under 35 U.S.C. 154(b) by 233 days.

(21) Appl. No.: 11/157,656

(22) Filed: Jun. 21, 2005

(65) Prior Publication Data

US 2006/0283639 A1 Dec. 21, 2006

(51) Int. Cl.
*E21B 10/52* (2006.01)

(52) U.S. Cl. ..... 175/432; 175/434

(58) Field of Classification Search ..... 175/432, 175/434, 430

See application file for complete search history.

(56) References Cited

U.S. PATENT DOCUMENTS

| | | | |
|---|---|---|---|
| 2,578,593 | A | 12/1951 | Phipps |
| 3,388,757 | A | 6/1968 | Fittinger |
| 3,442,342 | A | 5/1969 | McElya et al. |
| 3,442,352 | A | 5/1969 | McElya et al. |
| 3,946,820 | A | 3/1976 | Knapp |
| 4,056,153 | A | 11/1977 | Miglierini |
| 4,058,177 | A | 11/1977 | Langford, Jr. et al. |
| 4,086,973 | A | 5/1978 | Keller et al. |
| 4,108,260 | A | 8/1978 | Bozarth |
| 4,254,840 | A | 3/1981 | Shay, Jr. |
| 4,334,586 | A | 6/1982 | Schumacher |
| 4,352,400 | A | 10/1982 | Grappendorf et al. |
| 4,511,006 | A | 4/1985 | Grainger |
| 4,586,574 | A | 5/1986 | Grappendorf |
| 4,716,977 | A | 1/1988 | Huffstutler |
| 4,722,405 | A | 2/1988 | Langford, Jr. |
| 4,811,801 | A | 3/1989 | Salesky et al. |

(Continued)

FOREIGN PATENT DOCUMENTS

| | | |
|---|---|---|
| EP | 0 391 683 | 10/1990 |

(Continued)

OTHER PUBLICATIONS

Search Report for Appln. No. GB 0 403 620.8 dated May 5, 2004 (2 p.).

(Continued)

*Primary Examiner*—William P Neuder
(74) *Attorney, Agent, or Firm*—Conley Rose, P.C.

(57) ABSTRACT

A rolling cone bit and a cutting insert for a rolling cone are disclosed. The insert includes an undulating cutting surface including a peak, and blades radiating therefrom. The cutting insert may include an ultrahard layer of diamond or other superabrasive material, wherein the outer cutting surface of the layer includes contours that generally correspond to the contours of the interface surface that is between the ultrahard layer and the substrate so as to reduce residual stresses and lessen the likelihood of spalling or delamination of the ultrahard material. The blades radiate from a central peak and may include a sharper and/or higher leading edge as compared to a trailing edge. Valleys between the blades may differ in depth, and the cutting surface may have an undulating perimeter.

40 Claims, 7 Drawing Sheets

U.S. PATENT DOCUMENTS

| | | | | |
|---|---|---|---|---|
| 4,832,139 | A | 5/1989 | Minikus et al. | |
| 4,854,405 | A | 8/1989 | Stroud | |
| 4,951,762 | A | 8/1990 | Lundell | |
| D324,527 | S | 3/1992 | Slutz | |
| 5,131,478 | A | 7/1992 | Brett et al. | |
| 5,172,777 | A | 12/1992 | Siracki et al. | |
| 5,172,779 | A | 12/1992 | Siracki et al. | |
| 5,197,555 | A | 3/1993 | Estes | |
| 5,201,376 | A | 4/1993 | Williams | |
| 5,303,787 | A | 4/1994 | Brady | |
| 5,322,138 | A | 6/1994 | Siracki | |
| 5,323,865 | A | 6/1994 | Isbell et al. | |
| 5,341,890 | A | 8/1994 | Cawthorne et al. | |
| 5,351,768 | A | 10/1994 | Scott et al. | |
| 5,372,210 | A | 12/1994 | Harrell | |
| 5,379,854 | A | 1/1995 | Dennis | |
| 5,407,022 | A | 4/1995 | Scott et al. | |
| 5,415,244 | A | 5/1995 | Portwood | |
| 5,421,423 | A | 6/1995 | Huffstutler | |
| 5,421,424 | A | 6/1995 | Portwood et al. | |
| 5,429,199 | A | 7/1995 | Sheirer et al. | |
| 5,429,200 | A | 7/1995 | Blackman et al. | |
| 5,452,771 | A | 9/1995 | Blackman et al. | |
| 5,479,997 | A | 1/1996 | Scott et al. | |
| 5,518,077 | A | 5/1996 | Blackman et al. | |
| 5,533,582 | A | 7/1996 | Stroud | |
| 5,535,839 | A | 7/1996 | Brady | |
| 5,542,485 | A | 8/1996 | Pessier et al. | |
| 5,560,440 | A | 10/1996 | Tibbits | |
| 5,592,995 | A | 1/1997 | Scott et al. | |
| 5,636,700 | A | 6/1997 | Shamburger, Jr. | |
| 5,644,956 | A | 7/1997 | Blackman et al. | |
| 5,695,019 | A | 12/1997 | Shamburger, Jr. | |
| 5,697,462 | A | 12/1997 | Grimes et al. | |
| 5,709,278 | A | 1/1998 | Crawford | |
| 5,743,346 | A | 4/1998 | Flood et al. | |
| 5,746,280 | A | 5/1998 | Scott et al. | |
| 5,752,573 | A | 5/1998 | Scott et al. | |
| 5,755,301 | A | 5/1998 | Love et al. | |
| 5,813,485 | A | 9/1998 | Portwood | |
| 5,819,861 | A | 10/1998 | Scott et al. | |
| 5,833,020 | A | 11/1998 | Portwood et al. | |
| 5,839,526 | A | 11/1998 | Cisneros et al. | |
| 5,871,060 | A | 2/1999 | Jensen et al. | |
| 5,874,060 | A | 2/1999 | Armour et al. | |
| 5,881,828 | A | 3/1999 | Fischer et al. | |
| 5,887,655 | A | 3/1999 | Haugen et al. | |
| 5,887,668 | A | 3/1999 | Haugen et al. | |
| 5,890,550 | A | 4/1999 | Swadi et al. | |
| 5,915,486 | A | 6/1999 | Portwood et al. | |
| 5,950,745 | A | 9/1999 | Ingmarsson | |
| 5,967,245 | A | 10/1999 | Garcia et al. | |
| 6,029,759 | A | 2/2000 | Sue et al. | |
| 6,053,263 | A | 4/2000 | Meiners | |
| 6,059,054 | A | 5/2000 | Portwood et al. | |
| 6,105,693 | A | 8/2000 | Ingmarsson | |
| 6,105,694 | A | 8/2000 | Scott | |
| D430,578 | S | 9/2000 | Brady | |
| 6,161,634 | A | 12/2000 | Minikus et al. | |
| 6,176,332 | B1 | 1/2001 | Massa et al. | |
| 6,176,333 | B1 | 1/2001 | Doster | |
| 6,196,340 | B1 | 3/2001 | Jensen et al. | |
| 6,199,645 | B1 | 3/2001 | Anderson et al. | |
| 6,202,752 | B1 | 3/2001 | Kuck et al. | |
| 6,241,034 | B1 | 6/2001 | Steinke et al. | |
| 6,241,035 | B1 * | 6/2001 | Portwood | 175/374 |
| 6,290,008 | B1 * | 9/2001 | Portwood et al. | 175/426 |
| 6,367,568 | B2 | 4/2002 | Steinke et al. | |
| 6,510,910 | B2 | 1/2003 | Eyre et al. | |
| 6,530,441 | B1 | 3/2003 | Singh et al. | |
| 6,561,293 | B2 | 5/2003 | Minikus et al. | |
| 6,595,305 | B1 | 7/2003 | Dunn et al. | |
| 6,601,662 | B2 | 8/2003 | Matthias et al. | |
| 6,745,645 | B2 | 6/2004 | Griffo | |
| 6,782,959 | B2 | 8/2004 | Minikus et al. | |
| 6,883,624 | B2 | 4/2005 | McDonough | |
| 6,929,079 | B2 * | 8/2005 | McDonough et al. | 175/420.1 |
| 7,013,999 | B2 | 3/2006 | Tufts | |
| 7,040,424 | B2 | 5/2006 | Yong et al. | |
| 7,152,703 | B2 * | 12/2006 | Meiners et al. | 175/426 |
| 2004/0173384 | A1 | 9/2004 | Yong et al. | |
| 2005/0247492 | A1 | 11/2005 | Shen et al. | |

FOREIGN PATENT DOCUMENTS

| | | |
|---|---|---|
| EP | 0 446 765 | 9/1991 |
| EP | 0 527 506 | 2/1993 |
| EP | 0 902 159 | 3/1999 |
| GB | 2 361 497 | 10/2001 |
| GB | 2 369 841 | 6/2002 |
| GB | 2 393 982 | 4/2004 |
| GB | 2398330 | 8/2004 |
| RU | 2105124 | 2/1998 |
| RU | 2153569 | 7/2000 |
| WO | WO 01/61142 | 8/2001 |

OTHER PUBLICATIONS

Search Report for Appln. No. GB 0 402 108.5 dated Apr. 22, 2004; (1 p.).
Search Report for Appln. No. GB 0 416617.9 dated Sep. 9, 2004; (1 p.).
Search Report for Appln. No. GB 0404709.8 dated Sep. 23, 2004; (1 p.).
Office Action dated Nov. 24, 2008 for U.S. Appl. No. 11/619,416; (pp. 11).
Response to Office Action Dated Nov. 24, 2008 for U.S. Appl. No. 11/619,416 (23 p.).
Final Office Action Dated May 22, 2009 for U.S. Appl. No. 11/619,416 (20 p.).
Response to Final Office Action Dated May 22, 2009 for U.S. Appl. No. 11/619,416 (22 p).
Office Action Dated Nov. 13, 2008 for U.S. Appl. No. 11/619,395 (14 p.).
Response to Office Action Dated Nov. 13, 2008 for U.S. Appl. No. 11/619,395 (21 p.).
Notice of Allowance dated Apr. 20, 2009 for U.S. Appl. No. 11/619,395 (6 p.).
Office Action dated Aug. 25, 2009 for U.S. Appl. No. 11/858,359 (24 p.).
Office Action dated Jul. 9, 2009 for U.S. Appl. No. 11/947,226 (13 p.).
Response to Restriction Requirement and Response to Office Action dated Jul. 9, 2009 for U.S. Appl. No. 11/947,226 (15 p.).
Office Action Dated Sep. 3, 2004 for U.S. Appl. No. 10/371,388 (5 p.).
Response to Office Action Dated Sep. 3, 2004 for U.S. Appl. No. 10/371,388 (15 p.).
Notice of Allowance for U.S. Appl. No. 10/371,388 dated Apr. 13, 2005 (6 p).
Office Action Dated Sep. 23, 2004 for U.S. Appl. No. 10/379,015 (12 p.).
Response to Office Action Dated Sep. 23, 2004 for U.S. Appl. No. 10/379,015 (23 p).
Office Action Dated Feb. 22, 2005 for U.S. Appl. No. 10/379,015 (7 p.).
Response to Office Action Dated Feb. 22, 2005 for U.S. Appl. No. 10/379,015 (19 p).
Office Action dated Aug. 29, 2005 for U.S. Appl. No. 10/379,015 (7 p.).
Response to Office Action dated Aug. 29, 2005 for U.S. Appl. No. 10/379,015 (19 p.).
Notice of Allowance dated Jan. 31, 2006 for U.S. Appl. No. 10/379,016 (6 p.).

Office Action Dated Apr. 28, 2005 for U.S. Appl. No. 10/628,191 (12 p.).

Response to Office Action Dated Apr. 28, 2005 for U.S. Appl. No. 10/628,191 (26 p.).

Notice of Allowance Dated Oct. 12, 2005 for U.S. Appl. No. 10/628,191 (4 p.).

Office Action Dated Apr. 13, 2004 for U.S. Appl. No. 10/355,493 (10 p.).

Response to Office Action Dated Apr. 13, 2004 for U.S. Appl. No. 10/355,493 (32 p.).

Final Office Action Dated Aug. 23, 2004 for U.S. Appl. No. 10/355,493 (7 p.).

Response to Final Office Action Dated Aug. 23, 2004 for U.S. Appl. No. 10/355,493 (19 p).

Notice of Allowance Dated Dec. 20, 2004 for U.S. Appl. No. 10/355,493 (6 p).

Supplemental Response to Final Office Action Dated May 22, 2009 for U.S. Appl. No. 11/619,416 (16 p.).

Notice of Allowance Dated Nov. 16, 2009 for U.S. Appl. No. 11/619,415 (9 p).

* cited by examiner

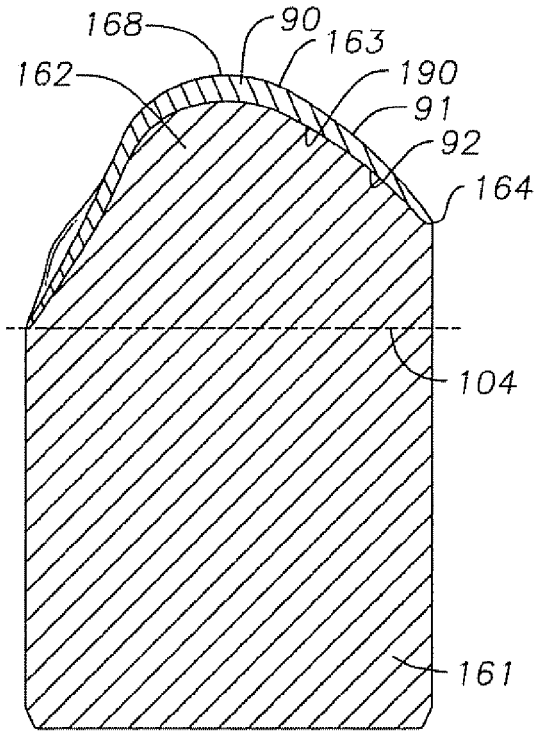
Fig. 5
Fig. 6
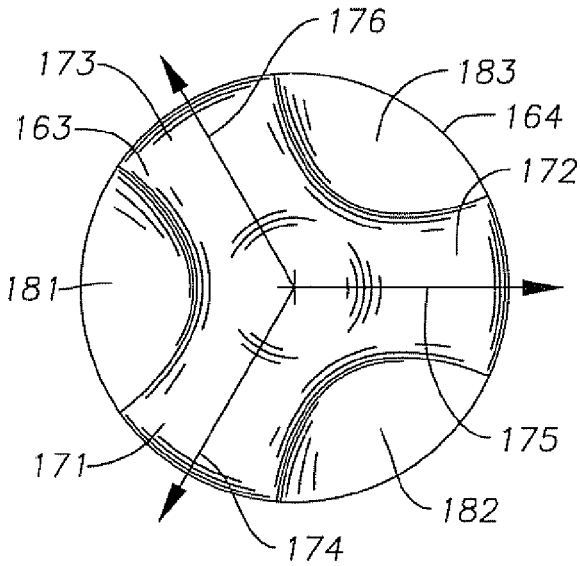
Fig. 7
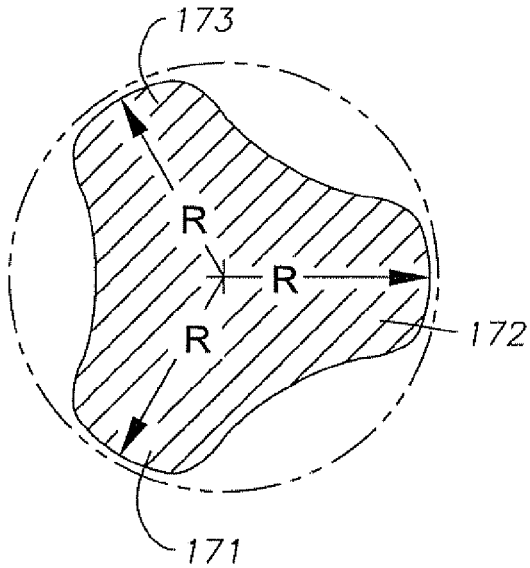

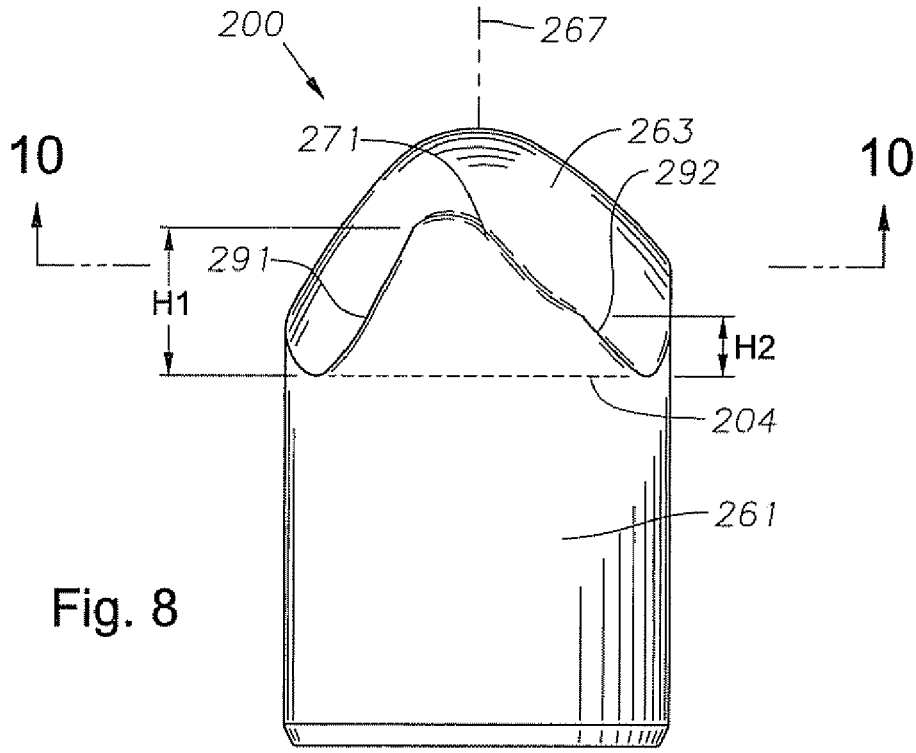
Fig. 8
Fig. 9
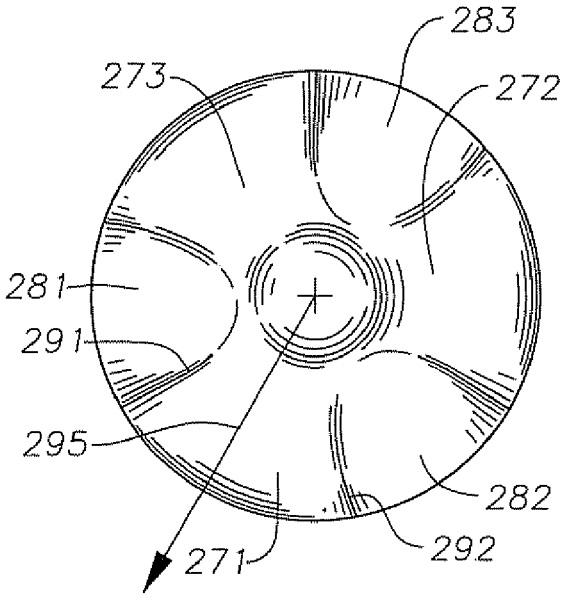
Fig. 10
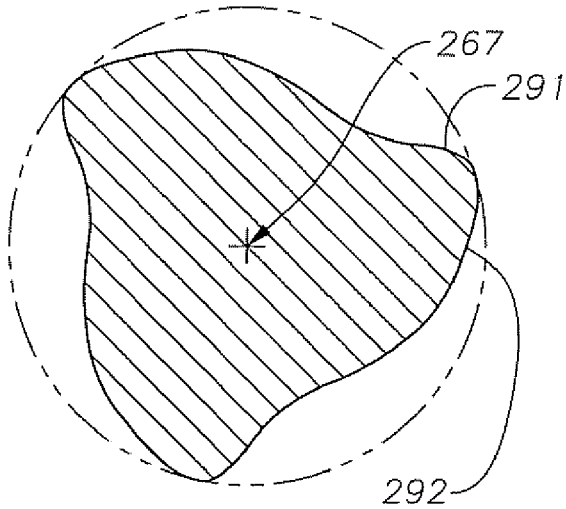

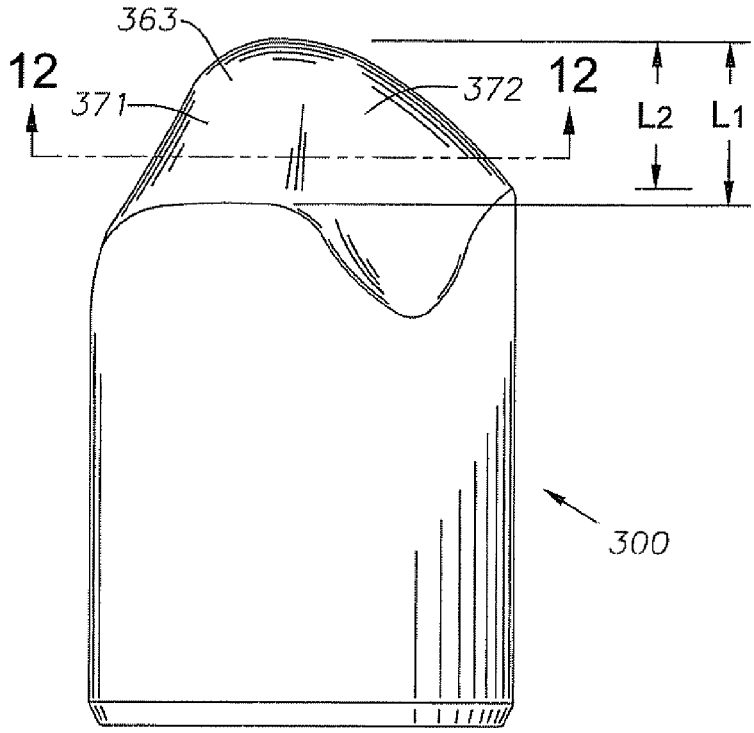
Fig. 11
Fig. 12
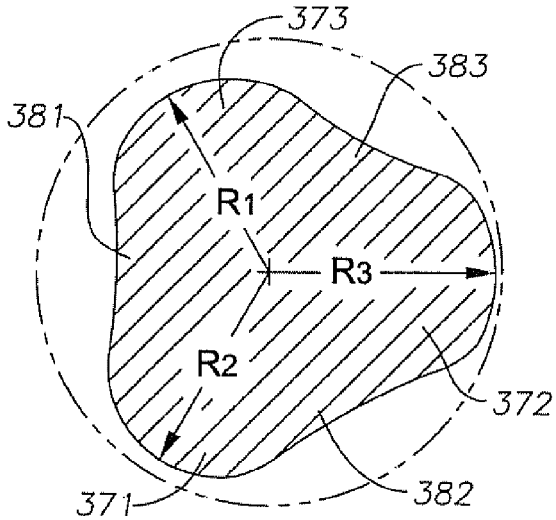
Fig. 13
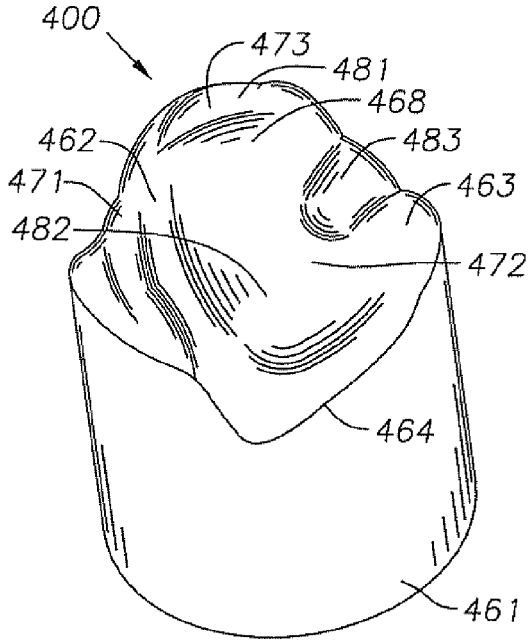

DRILL BIT AND INSERT HAVING BLADED INTERFACE BETWEEN SUBSTRATE AND COATING

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to earth boring bits used to drill a borehole for the ultimate recovery of oil, gas, or minerals. More particularly, the invention relates to rolling cone and percussion rock bits, and to an improved cutting insert for such bits. Still more particularly, the invention relates to enhancements in insert geometry and in the interface between an insert substrate and a wear-resistant coating.

2. Description of the Related Art

An earth-boring drill bit is typically mounted on the lower end of a drill string and is rotated by revolving the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

A typical earth-boring bit includes one or more rotatable cone cutters that perform their cutting function as they roll and slide upon the bottom of the borehole as the bit is rotated, the cone cutters thereby engaging and fracturing the formation material in their path. The rotatable cone cutters may be described as generally conical in shape and are therefore referred to as rolling cones or rolling cone cutters.

Rolling cone bits typically include a bit body with a plurality of journal segment legs. The rolling cones are mounted on bearing pins or shafts that extend downwardly and inwardly from the journal segment legs. The borehole is formed as the gouging and scraping or crushing and chipping action of the rotary cones removes chips of formation material which are carried upward and out of the borehole by drilling fluid which is pumped downwardly through the drill pipe and out of the bit.

The earth disintegrating action of the cone cutters is enhanced by providing the cone cutters with a plurality of cutter elements. Cutter elements are generally of two types: inserts formed of a very hard material, such as tungsten carbide, that are typically press fit into undersized apertures in the cone surface; or teeth that are milled, cast or otherwise integrally formed from the material of the rolling cone. Bits having tungsten carbide inserts are typically referred to as "insert bits" or "TCI bits," while those having teeth formed from the cone material are commonly known as "steel tooth bits." In each instance, the cutter elements on the rotating cone cutters breakup the formation to form new borehole by a combination of gouging and scraping or chipping and crushing.

In oil and gas drilling, the cost of drilling a borehole is proportional to the length of time it takes to drill to the desired depth and location. The time required to drill the well, in turn, is greatly affected by the number of times the drill bit must be changed before reaching the targeted location. This is the case because each time the bit is changed, the entire string of drill pipes, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer and which are usable over a wider range of formation hardness.

The length of time that a drill bit may be employed before it must be changed depends upon its ability to "hold gage" (meaning its ability to maintain a full gage borehole diameter), its rate of penetration ("ROP"), as well as its durability or ability to maintain an acceptable ROP. The geometry and positioning of the cutter elements upon the cone cutters greatly impact bit durability and ROP and thus, are critical to the success of a particular bit design.

Conventional cutting inserts typically have a body consisting of a cylindrical grip portion that is retained in the rolling cone cutter, and a cutting portion that extends from the grip portion and engages the formation material. These inserts are typically inserted in circumferential rows on the rolling cone cutters. Most such bits include a row of inserts in the heel surface of the cone cutters. The heel surface is a generally frustoconical surface and is configured and positioned so as to align generally with and ream the sidewall of the borehole as the bit rotates.

In addition to the heel row inserts, conventional bits typically include a circumferential gage row of cutter elements mounted adjacent to the heel surface but oriented and sized so as to cut the corner of the borehole. In performing their corner cutting duty, gage row inserts perform a reaming function, as a portion of the insert scraps or reams the side of the borehole. Gage row inserts also perform bottom hole cutting, a duty in which the inserts gouge the formation material at the bottom of the borehole.

Conventional bits also include a number of additional rows of cutter elements that are located on the cones in circumferential rows disposed radially inward or in board from the gage row. These cutter elements are sized and configured for cutting the bottom of the borehole, and are typically described as inner row cutter elements.

A variety of different shapes of cutter elements have been devised. In most instances, each cutter element is designed to optimize the amount of formation material that is removed with each "hit" of the formation by the cutter element. At the same time, however, the shape and design of a particular cutter element is also dependent upon the location in the drill bit in which it is to be placed, and thus the cutting duty to be performed by that cutter element. For example, heel row cutter elements are generally made of a harder and more wear resistant material, and have a less aggressive cutting shape for reaming the borehole side wall, as compared to the inner row cutter elements where the cutting duty is more of a gouging, digging and crushing action. Common geometries for inner row cutter elements are chisel or conical shapes.

It is understood that cutter elements, depending upon their location in the rolling cone cutter, have different cutting trajectories as the cone cutter rotates in the borehole. Thus, conventional cutter elements have been oriented in the rolling cone cutters in a direction believed to cause optimal formation removal. However, it is now understood that cutter elements located in certain portions of the cone cutter have more than one cutting mode. More particularly, cutter elements in the inner rows of the cone cutters, especially those closest to the nose of the cone cutter (and the center line of the bit), include a twisting motion as they gouge into and then separate from the formation. Unfortunately, however, conventional cutter elements, such as a chisel shaped insert, having a single primary cutting edge, are usually oriented to optimize the cutting that takes place only in the cutter's circumferential cutting trajectory, as they do not have particular features to take advantage of cutting opportunities arising from the twisting motion of the cutter element.

Accordingly, to provide a drill bit with higher ROP, and thus to lower drilling costs incurred in the recovery of oil and other valuable resources, it would be desirable to provide cutter elements designed and oriented so as to enhance brittle fracture of the rock formation being drilled, and to present to the formation multiple cutting edges as the cutting surface of the cutter element rotates through its cutting trajectory so as to take advantage of multiple cutting modes.

At the same time, it is desirable to make the inserts wear-resistant so as to increase the useful life of the bit and decrease the numbers of times the bit must be replaced. In order to improve their operational life, these inserts are preferably formed from a substrate body that is coated with an ultrahard and wear-resistant material, such as a layer of polycrystalline diamond, thermally stable diamond or any other ultrahard material. The substrate, which supports the coated cutting layer, is normally formed of a hard material such as tungsten carbide (WC). The basic techniques for constructing polycrystalline diamond enhanced cutting elements are generally well known, and can be summarized as follows: a carbide substrate is formed having a desired surface configuration and then placed in a mold- with a- superhard material, such as diamond powder and/or its mixture with other materials which form transition layers, and subjected to high temperature and pressure, resulting in the formation of a diamond layer bonded to the substrate surface.

Despite the advantages and improvements provided by diamond coated inserts, such inserts sometimes fail in use. In particular, it has been found difficult to employ diamond coated inserts on the inner rows of rolling cone rock bits where they must endure substantial impact loads as the cutting inserts gouge and cut the borehole bottom. One typical failure mode is caused by internal stresses, for example thermal residual stresses resulting from the manufacturing process, which tend to cause delamination between the diamond layer and the substrate or the transition layer, either by cracks initiating along the interface and propagating outward, or by cracks initiating in the diamond layer surface and propagating catastrophically along the interface. One explanation for such failures is that the interface between the diamond and the substrate or a transition layer is subject to high residual stresses resulting from the manufacturing processes of the cutting element. Specifically, because manufacturing occurs at elevated temperatures, the differing coefficients of thermal expansion of the diamond and substrate material or transition layer result in thermally-induced stresses as the materials cool down from the manufacturing temperature. These residual stresses tend to be larger when the diamond/transition-layer/substrate interfaces have smaller radii of curvature. In part for this reason, where diamond coated inserts have been employed in certain formations, the inserts are typically formed with the carbide/diamond interface surface having a relatively large radii of curvature and uncomplicated geometries, such as generally hemispherical shaped tops or relatively blunt chisel shapes. At the same time, as the radius of curvature of the interface increases, the application of cutting forces due to contact of the formation on the cutter element produces larger stresses at the interface, which can enhance the detrimental effects of the residual stresses and result in delamination.

The primary approach used to address the delamination problem in convex cutter elements is the addition of transition layers between the ultrahard material layer and the substrate, applied over the entire substrate interface surface. These transition layers are made of materials with particular thermal and elastic properties and tend to reduce the residual stresses at the interface, thus improving the insert's resistance to delamination. U.S. Pat. No. 6,315,065, commonly owned by the assignee of the present patent application, describes certain inserts and transition layers and is hereby incorporated by reference in its entirety. Nevertheless, residual stresses cannot be entirely eliminated and still cause insert failure.

More specifically, the residual stresses, when augmented by the repetitive stresses attributable to the cyclical loading of the cutting element by contact with the formation, may cause spalling, fracture and delamination of the diamond layer from the transition layer or the substrate. In addition to the foregoing, state of the art cutting elements often lack sufficient diamond volume to cut highly abrasive formations, as the thickness of the diamond layer tends to be limited by the resulting high residual stresses and the difficulty of bonding a relatively thick diamond layer to a curved substrate surface even with the employment of the transition layers. Hence, it is desired to provide a cutting element that provides increased bit life, and that enhances the cutting insert's ability to resist spalling, delamination and failure modes caused or accelerated by residual stresses.

SUMMARY OF THE PREFERRED EMBODIMENTS

The embodiments disclosed herein provide a cutter element for a drill bit, where the cutter element includes a peak, and blades radiating from the peak to the cutting. surface's perimeter. Valleys are formed between the blades. The peak, the blades and the valleys form an undulating cutting surface. The undulating cutting surface provides both penetration and gouging, as well as a shearing cutting action, and provides particular utility mounted in a cone cutter for bottom hole cutting. The cutter element may be employed both in a single cone and multi-cone bit, as well as in a percussion or hammer bit.

In certain embodiments, the cutter element includes a substrate having an interface surface including a peak and a plurality of blades radiating from the peak forming an undulating interface surface, and a superabrasive layer supported on the interface surface. The surface of the superabrasive layer facing away from the interface surface is contoured to substantially match the undulations of the interface surface.

In certain embodiments described herein, the blades include a leading edge and a trailing edge, where the leading edge of one of the blades has a greater extension height than the trailing edge of the blade. In another aspect of the invention, the cutter element may include a blade having a leading edge sharper than its trailing edge. In certain embodiments, the angles formed between pairs of blades may be uniform, or they may differ. In another aspect of the present cutter element, the blades include a radius as measured perpendicular to the cutter element longitudinal axis. In some embodiments, the radii of the various blades differ.

Varying the geometry of the blades offers the potential to provide enhanced cutting action allowing the cutter element to remove formation material in multiple modes as the cutter element moves about the borehole and through its cutting trajectory. In particular, the relatively sharp cutting structure is useful in gouging the borehole bottom and removing formation material in that mode. Additionally, the radiating blades provide enhanced shearing action to remove formation material as the cutter element undergoes a twisting motion during the time between it enters and then leaves the formation material. At the same time, providing a diamond or other superabrasive layer to form the cutting surface provides enhanced wear resistance. In particular, providing the superabrasive cutting surface with contours that generally correspond to the contours of the interface surface reduces residual stresses that otherwise may lead to premature spalling, or delamination of the superabrasive material and, ultimately, lead to premature bit failure.

These and other features and characteristics of these cutting inserts and drill bits are described in more detail below. The various characteristics described above, as well as other features described in more detail below, will be readily apparent to those skilled in the art upon reading the following detailed description of the preferred embodiments, and by referring to the accompanying drawings.

BRIEF DESCRIPTION OF THE DRAWINGS

For a more detailed description of the preferred embodiments, reference will now be made to the accompanying drawings, wherein:

FIG. 5 is a sectional view of the insert shown in FIG. 4.

FIG. 6 is a top view of the insert shown in FIG. 4.

FIG. 7 is a cross-sectional view taken along plane 7-7 as shown in FIG. 4.

FIG. 8 is a side elevation view of another cutting insert suitable for use in the drill bits described herein.

FIG. 9 is a top view of the insert shown in FIG. 8.

FIG. 10 is a cross-sectional view taken along plane 10-10 as shown in FIG. 8.

FIG. 11 is side elevation view of another insert suitable for use in the drill bits described herein.

FIG. 12 is a section view taken along plane 12-12 as shown in FIG. 11.

FIG. 13 is a perspective view of another insert suitable for use in the drill bits described herein.

DETAILED DESCRIPTION OF THE PREFERRED EMBODIMENTS

As used herein to compare or claim particular features or characteristics (such as, for example, heights, lengths, angles) or mechanical properties, the term "differs" or "different" means that the value or magnitude of the characteristic being compared varies by an amount that is greater than that resulting from accepted variances or tolerances normally associated with the manufacturing processes that are used to formulate the raw materials and to process and form those materials into a cutter element or drill bit. Thus, particular characteristics selected so as to have the same nominal value will not "differ," as that term has thus been defined, even though the characteristics, if measured, would vary about the nominal value by a small amount.

Figure 1:
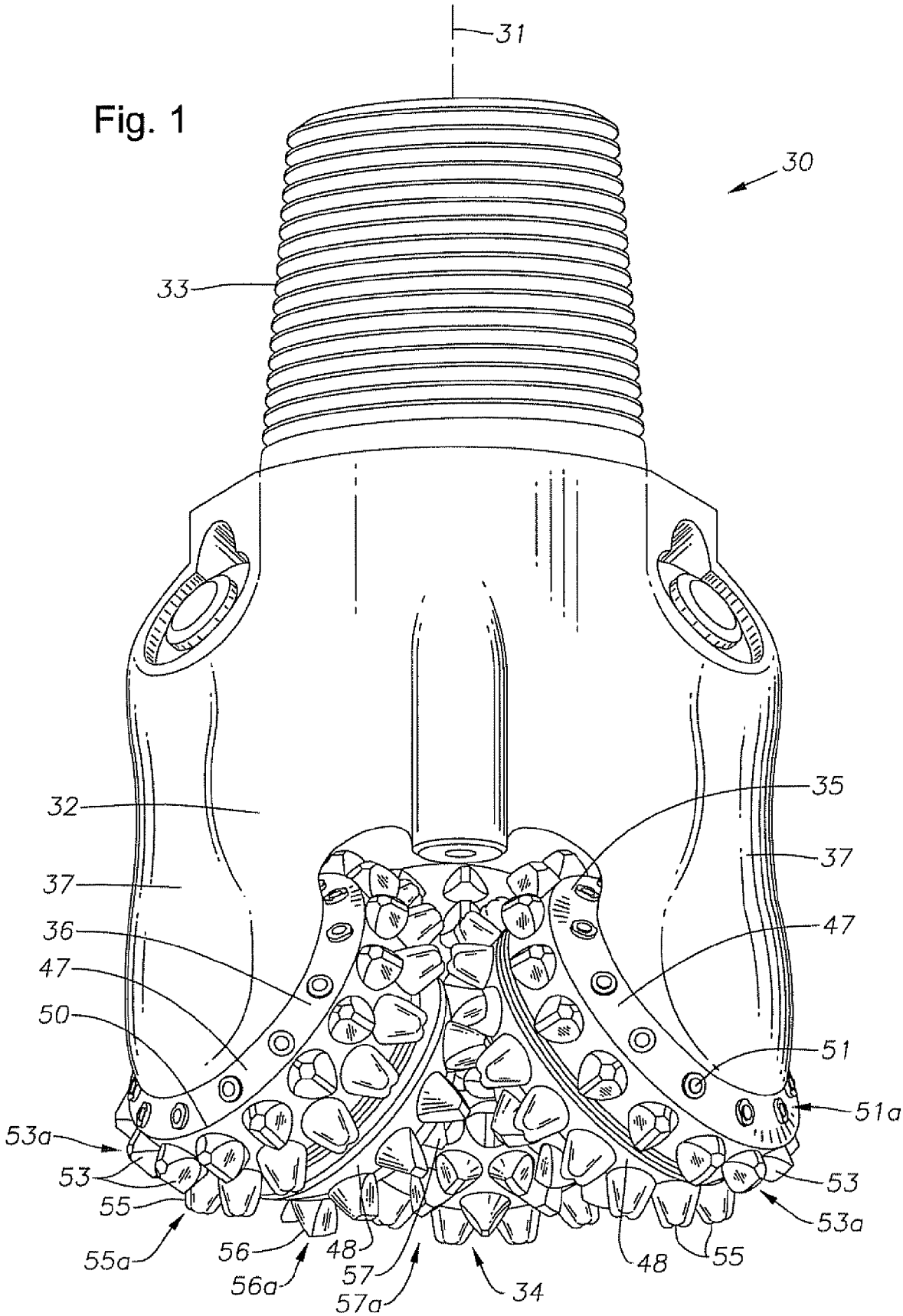
FIG. 1 is a perspective view of an earth boring, three cone bit having cutting inserts in accordance with the present invention.

Referring first to FIG. 1, an earth-boring bit 30 includes a central axis 31 and a bit body 32 having a threaded section 33 on its-upper-end for securing the bit to the drill string (not shown). Bit 30 has a predetermined gage diameter as defined by three rolling cone cutters 34, 35, 36 rotatably mounted on bearing shafts (not shown) that extend from the bit body 32. This disclosure will be understood with a detailed description of one such cone cutter 34, with cones 35, 36 being similarly, although not necessarily identically, configured. Bit body 32 is composed of three sections, or legs 37 (two shown in FIG. 1), that are joined together to form bit body 32.

Figure 2:
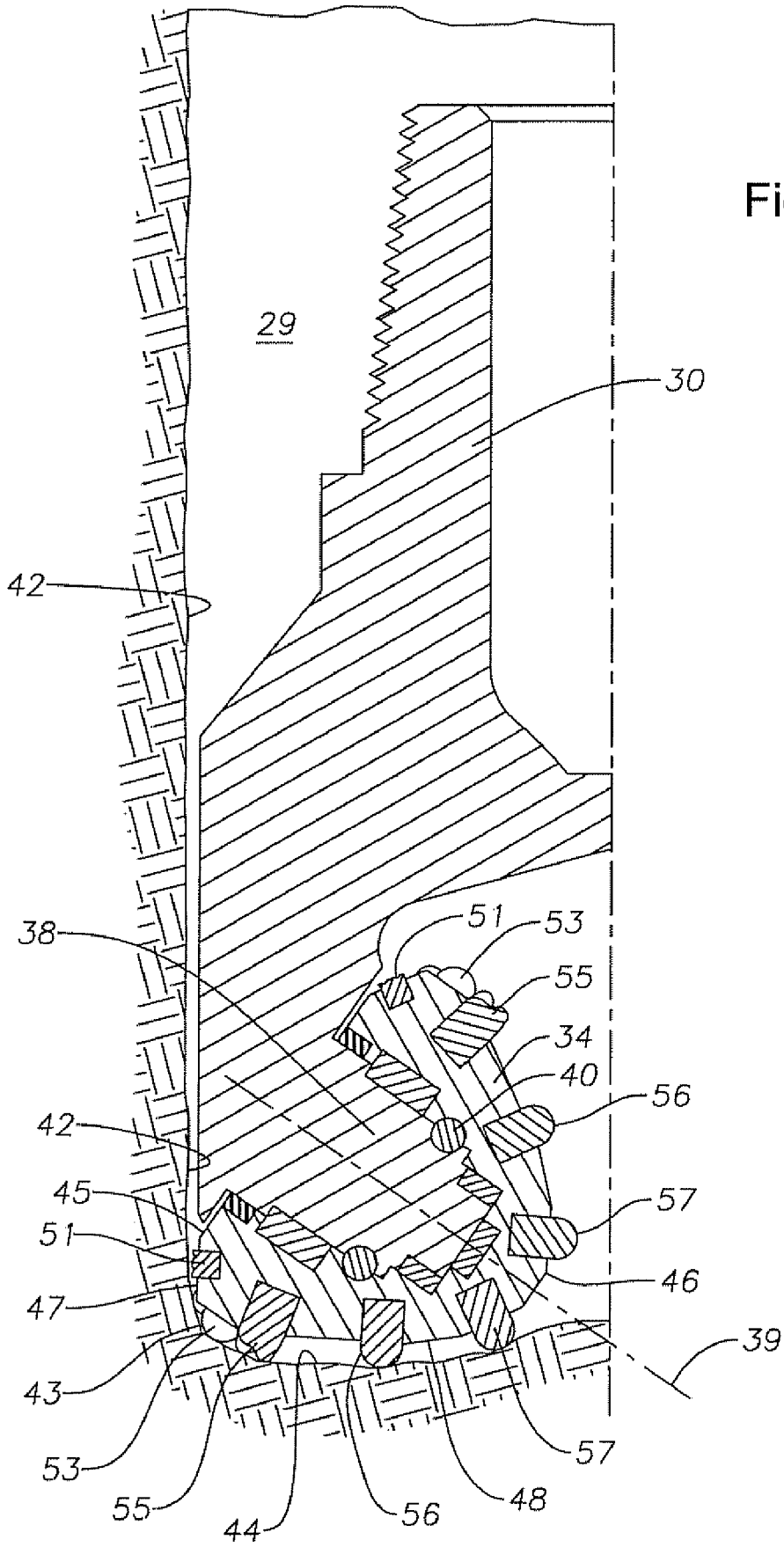
FIG. 2 is a partial sectional view taken through one leg and one rolling cone of the drill bit shown in FIG. 1.

Referring now to FIG. 2, bit 30 is shown inside a borehole 29 that includes sidewall 42, corner portion 43 and bottom 44. Cone cutter 34 is rotatably mounted on a pin or journal 38, with the cone's axis of rotation 39 oriented generally downward and inward towards the center of bit 30. Cone cutter 34 is secured on pin 38 by ball bearings 40.

Referring to FIGS. 1 and 2, each cone cutter 34-36 includes a backface 45 and nose portion 46 generally opposite backface 45. Cutters 34-36 further include a frustoconical heel surface 47. Frustoconical surface 47 is referred to herein as the "heel" surface of cutters 34-36, it being understood, however, that the same surface may sometimes be referred to by others in the art as the "gage" surface of a rolling cone cutter. Extending between heel surface 47 and nose 46 is a generally conical surface 48 adapted for supporting cutter elements which gouge or crush the borehole bottom 44 as the cone cutters 34-36 rotate about the borehole. Frustoconical heel surface 47 and conical surface 48 converge in a circumferential edge or shoulder 50 (FIG. 1).

Cone cutters 34-36 include a plurality of tooth-like cutter elements for gouging, scraping and chipping away the surfaces of the borehole. The cutter elements retained in cone cutter 34 include a plurality of heel row inserts 51 that are secured in a circumferential row 51*a* in the frustoconical heel surface 47. Cone cutter 34 further includes a circumferential row 53*a* of gage inserts 53 secured to cone cutter 34 in locations along or near the circumferential shoulder 50. Cone cutter 34 also includes a plurality of inner row inserts, such-as inserts 55, 56, 57 secured to the generally conical cone surface 48 and arranged in spaced-apart inner rows such as 55*a*, 56*a*, 57*a*.

Referring again to FIG. 2, heel inserts 51 generally function to scrape or ream the borehole sidewall 42 to maintain the borehole at full gage and prevent erosion and abrasion of heel surface 47. Gage row cutter elements 53 cut the corner of the borehole and endure side wall and bottom hole forces as they perform their cutting duty. Inner row cutter elements 55-57 are employed primarily to gouge and crush and thereby remove formation material from the borehole bottom 44. Inner rows 55*a*, 56*a*, 57*a*, are arranged and spaced on cone cutter 34 so as not to interfere with the inner rows on each of the other cone cutters 35, 36.

Figure 3:
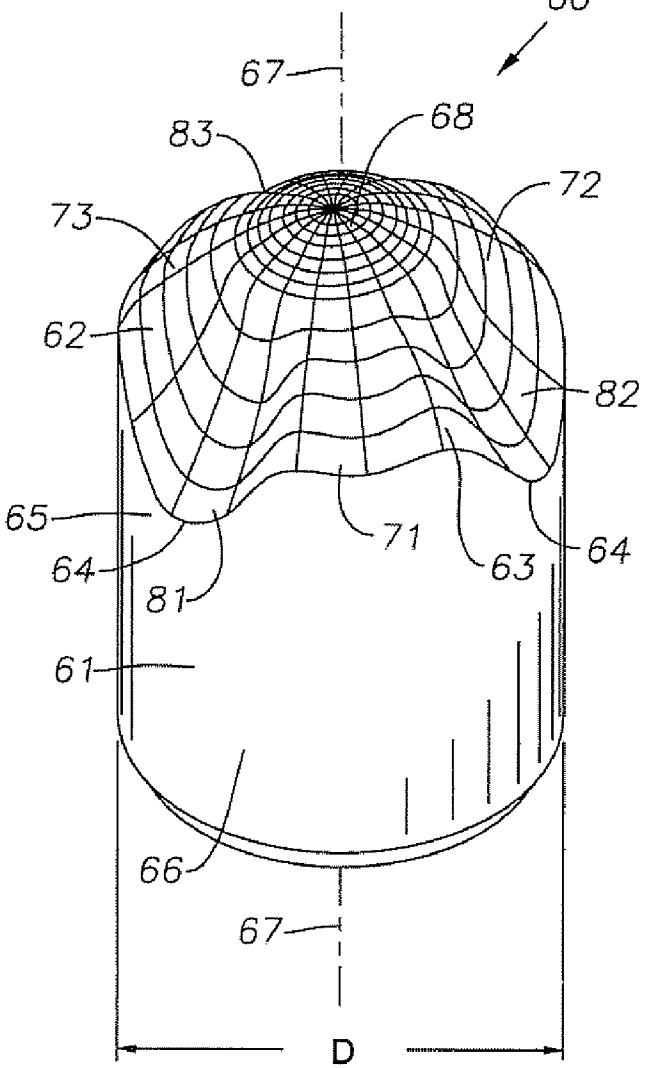
FIG. 3 is a perspective view of a cutting insert suitable for use in the drill bit of FIG. 1 and FIG. 14.

Referring now to FIG. 3, there is shown a cutter element in a form of an insert 60 having particular utility as an inner row cutter element, such as in the position of elements 55, 56, 57 in cone cutters 34-36 of rolling cone drill bit 30. Insert 60 includes a grip or base portion 61, central axis 67, and a cutting portion 62 extending from the base. Base 61 has a generally cylindrical side surface 66 and diameter D. Base portions having noncircular profiles may also be employed.

The cutter element base 61 is retained an aperture formed in the cone cutter such that only cutting portion 62 of element 60 extends above the cone steel.

Cutting portion 62 includes undulating cutting surface 63 and flank surfaces 65. Preferably, cutting surface 63 is continuously contoured and extends to a cutting surface perimeter 64 where it joins flank surfaces 65. As used herein, the terms "continuously contoured" and "sculptured" refer to surfaces that can be described as having continuously curved surfaces that are free of relatively small radii (less than 0.08 inches) that are conventionally used to break sharp edges or round off transitions between adjacent distinct surfaces. Flank surfaces 65 are curved surfaces extending from and having the same radius as base cylindrical surface 66.

As shown in FIG. 3, cutting surface 63 includes a cutting tip or peak portion 68 and a series of blade portions 71, 72, 73 extending radially from the peak 68 to the outer perimeter 64 of the cutting surface. In this embodiment, peak portion 68 is centrally located on the cutting surface 63 and is aligned with axis 67. In other embodiments, peak portion 68 may be offset or radially displaced from axis 67. Between each pair of blades is a valley portion 81, 82, 83 that likewise radiates from the cutting tip 68 to the perimeter 64 of the cutting surface. In this manner, cutting surface 63 presents an undulating cutting surface and includes a non-planar and undulating intersection with flanks 65 at perimeter 64. As described in more detail below, cutting surface 63 and flank surfaces 65 preferably include a coating of diamond or other ultrahard or superabrasive material. The tip 68 of the cutting surface is preferably radiused, and the radius of the tip, the extension height of the cutting surface above the base 61, and other features of insert 60 may be varied to present a sharper and more aggressive cutting surface, or a more dull cutting surface, depending on the formation material and other parameters.

Figure 4:
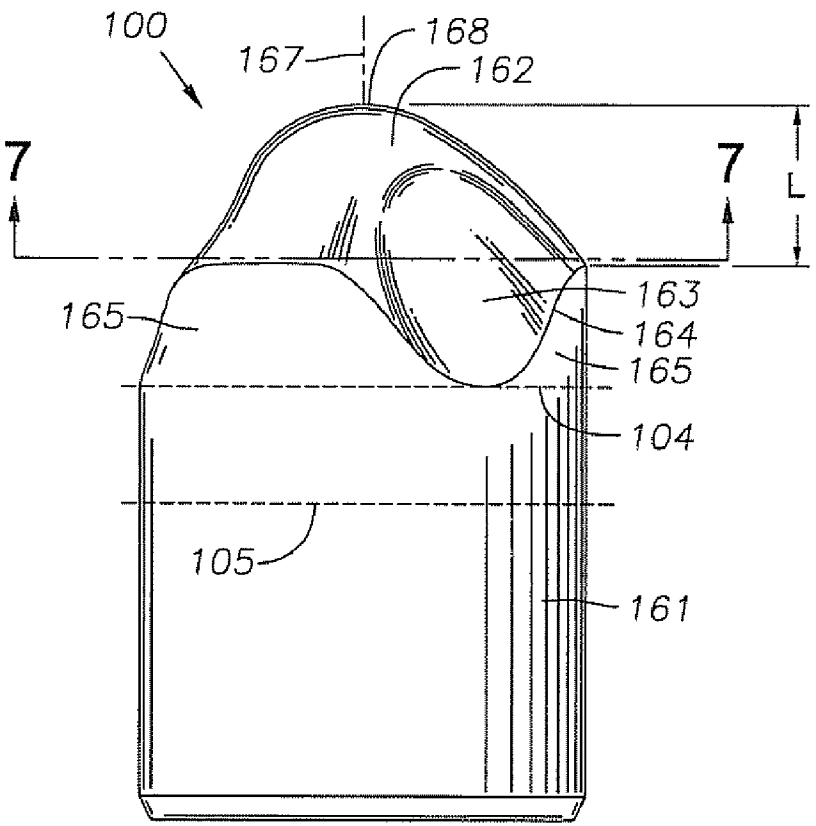
FIG. 4 is a side elevation view of another cutting insert suitable for use in the drill bits described herein.

Referring now to FIG. 4, a cutting insert 100 is shown that is likewise particularly suited for use in the inner rows 55*a*, 56*a*, 57*a* of cones 34-36. Insert 100 includes a grip or base portion 161 substantially the same as base portion 61 previously described. Insert 100 includes a cutting portion 162 which meets base 161 in a plane of intersection 104. Base portion 161 is disposed in an aperture in cone cutter 34, 35 or 36 and retained in the cone steel. The cutting portion 162, i.e., the portion of insert 100 extending above plane 104, extends beyond the cone steel. As shown in FIG. 4, cutting portion 162 includes an undulating cutting surface 163 extending to undulating perimeter 164 disposed above plane of intersection 104. As likewise shown in FIG. 4, cylindrical flank surfaces 165 on cutting portion 102 extend between base portion 161 and undulating perimeter 164. It is to be noted that although the plane of intersection 104 is shown in FIG. 4 as being tangent to cutting surface perimeter 164, the intersection between cutting portion 162 and base portion 161 may be at other axial locations on the insert. For example, the cutting portion and base portion may intersect at plane 105 shown in FIG. 4. In that instance, insert 100 would be embedded in the cone steel up to plane of intersection 105 so as to provide a cutting portion with greater axial length than if insert 100 were embedded up to plane 104. In such embodiment, flank portion 165 would include a cylindrical region (the region shown in FIG. 4 between planes 104 and 105) that extends beyond the cone steel and into the formation.

A longitudinal cross-section of insert 100 taken through the central axis 167 is shown in FIG. 5. As shown, the cutting portion 162 includes a diamond layer 90 that is thickest at the cutting tip 168, with the diamond thickness decreasing toward the perimeter 164 of the cutting surface 163.

FIG. 6 shows a top view of the cutting surface 163 of the insert 100 showing three blades 171-173 radially extending from the cutting tip 168 to the perimeter 164. As shown in this embodiment, the blades are substantially the same size and shape and are symmetrically spaced apart. The blades 171-173, which may be described as having blade axes 174-176, respectively, are angularly spaced approximately 120° apart as measured between the blade axes.

A cross-sectional view of the cutter element 100 taken perpendicular to element axis 167 at the location shown in FIG. 4 is depicted in FIG. 7. As shown in FIG. 7, in this embodiment, the blades 171-173 are shown to include a uniform radius R when the curvature of the outer surface of the blades is compared in a cross-sectional view at the same axial position. That is, in a cross-section taken at another axial location than that shown in FIG. 4, the blade radius R may be greater or lesser than that shown as R in FIG. 7; however, in this embodiment, the radius of each blade 171-173 will be substantially the same wherever the section is taken.

Referring still to FIG. 4, a blade extension length is shown as being the axial length measured parallel to axis 167 and measured from the point where the blade intersects the perimeter the cutting surface to the cutting tip 168. In the embodiment shown in FIG. 4, blades 171-173 are disposed symmetrically about axis 167, and each has the same extension length L.

Compared to many conventional prior art inserts in which the cutting surface is a relatively dull non-aggressive shape, the cutter element shown in FIGS. 3-7 provides a sharper cutting geometry enhancing the capacity of the insert to penetrate the formation. At the same time, the cutting geometry provides greater strength against breakage as compared to, for example, extremely long or tapered conical shaped inserts.

Figure 14:
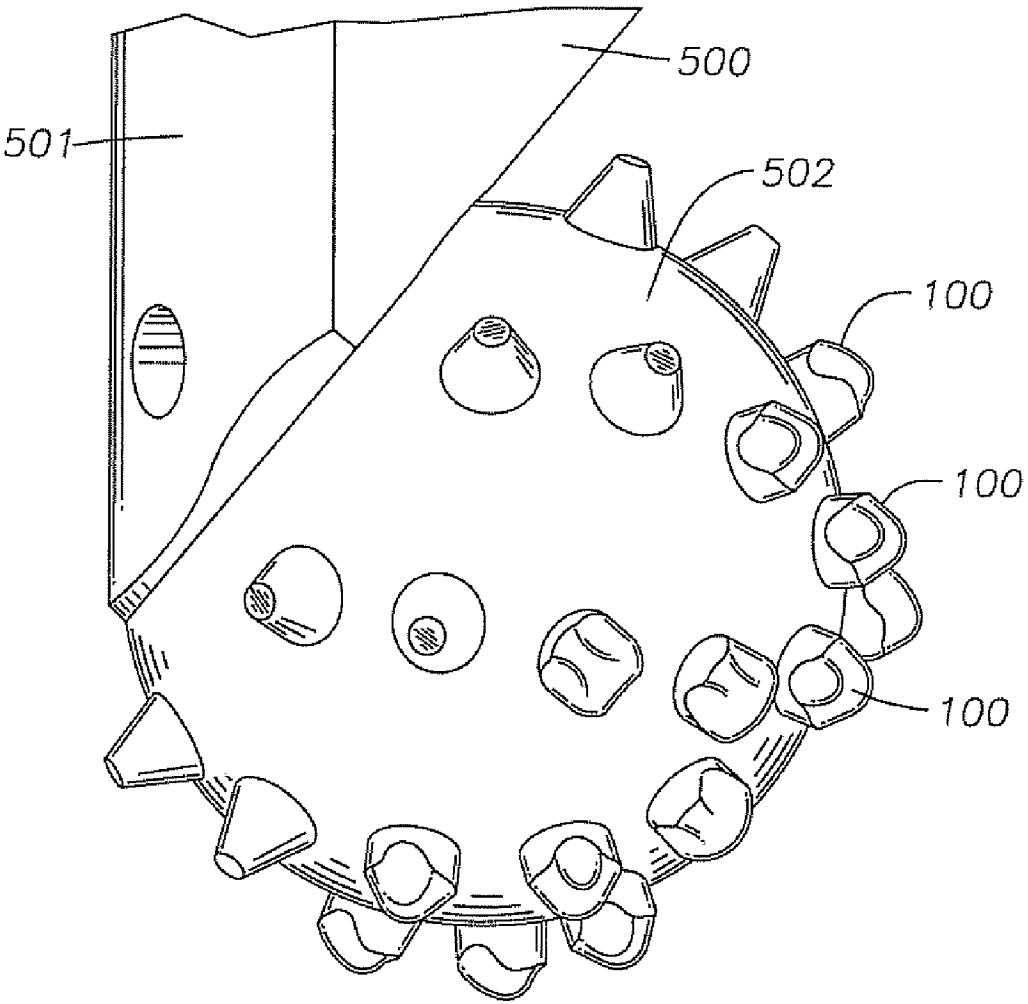
FIG. 14 is a perspective view of a single cone earth boring bit having cutter elements as described herein.

In addition, the valleys 181-183 (FIGS. 4, 6) and valleys 81-83 (FIG. 3) formed between the blades in the cutting surfaces of the inserts described above provide cooling paths or channels for drilling fluid to cool the cutter elements and better clean cuttings away from the cutting tip of the cutter element. Further, the multiple blades of the cutting surfaces shown and described above are intended to enhance drilling by taking advantage of the multiple cutting paths or trajectories of the cutter element. In particular, when employed in an inner row in a three cone bit such as bit 30 of FIG. 1, the cutter elements 60,100 previously described will cut the formation material both with a gouging and a twisting motion. The blades provided by the geometries described above will enable the inserts to scrape and chip away formation material as the cutter element undergoes a twisting motion and the blades sweep across the formation surface. The coating of diamond or other ultrahard or superabrasive material enhances the inserts' wear-resistance, and thus enhances bit life. Similarly, insert 100 previously described with reference to three cone bit 30, may be advantageously employed in single cone bits, such as bit 500 shown in FIG. 14. Referring to FIG. 14, bit 500 includes a single rolling cone cutter 502 rotatably mounted on bit body 501. Inserts 100 are press-fit or otherwise retained in rows in the cone steel of cone cutter 502. Unlike the cutting action in a three cone bit, where inserts 100 employed in an inner row only intermittently engage the formation material, inserts 100 employed where shown in single cone bit 500 actively cut the rock formation continuously throughout a revolution of the drill bit. As such, inserts 100 shown in the single cone application of FIG. 14 perform the cutting function of the three cone bit's heel row, gage row, and inner row cutter elements. In particular, the bladed cutting structure of inserts 100 employed in bit 500 as shown in FIG.

14 enhances formation removal due to the shearing cutting action provided by the inserts' blades, as well as by the penetration and gouging facilitated by means of the inserts' relatively sharp geometry.

Although the embodiment shown in FIGS. 3-7 included a diamond or other super-abrasive material, the cutter elements may be employed having the geometry described above but without the super-abrasive coatings. Likewise, although three blades are shown in the embodiments above, a fewer or greater number of blades (symmetrically disposed about the cutting surface or asymmetrically disposed) may also be employed. Likewise, the radius of the blades, the blade extension height, and the depth of the valleys may be varied from insert to insert, and within the cutting surface of a single insert.

As a further example, another cutter element 200 is shown in FIGS. 8-10. Cutter element 200 includes base portion 261 and an undulating cutting surface 263 that intersects base portion 261 at plane of intersection 204. Cutting surface 263 includes blades 271-273 and valleys 281-283 disposed between the blades. As best shown in FIG. 8, the leading and trailing portions of a blade surface may differ in radius and height so as to provide a sharper or more dull (and less susceptible to breakage) profile. More particularly, as shown in FIG. 8, the leading edge 291 of the blade 271 is higher (extends further from plane of intersection 204) than the trailing edge 292. As measured in the axial direction shown in FIG. 8, the leading edge 291 has a greater extension height H1 as compared to the extension height H2 of trailing edge 292. As opposed to the embodiment shown in FIGS. 3 and 4, for example, the insert of FIG. 8 requires less force for the insert to penetrate the rock formation due to the greater extension height H1 of leading edge 291. At the same time, the leading edge 291 will provide a shearing force as the element gouges the formation and twists. In this embodiment, and as best shown in FIG. 9, each blade is symmetric relative to its blade axis 295, the blade axis 295 bisecting each blade as measured relative to the leading and trailing edges 291, 292, respectively. FIG. 10, a cross-sectional view of the cutting surface 263 taken where shown in FIG. 8, illustrates the geometry providing a sharper leading edge 291. Trailing edge 292 is recessed away from the outer edge of the insert's profile toward the insert axis 267.

Referring to FIGS. 11 and 12, a cutter element 300 having particular utility in an inner row of cone cutters 34-36 is shown. As with the previous examples, in this embodiment, the cutter element 300 includes three blades 371-373 symmetrically spaced 120° apart. Valleys 381-383 are formed in the undulating cutting surface 363 between the blades. As best shown in FIG. 11, the blades include differing blade extension lengths. In particular, blade 371 includes a blade extension length L1 that is greater than the blade extension length L2 of blade 372.

As shown in FIG. 12, the blade radius of blades 371-373 differ and, in this embodiment, the radius R3 of blade 372 is greater than radius R2 of blade 371, which is greater than radius R1 of blade 373. Again, as compared to an insert that does not include the blades 371-373 and valleys 381-383 described above, the cutter element 300 will provide a smaller cross-section to the resistance force of the formation, so as to make penetration into the formation easier with a given weight-on-bit. Likewise, the blades 371-373 provide a shearing action as the cutter element 300 twists while moving through its cutting trajectory.

Referring now to FIG. 13, another insert 400 is shown including a base portion 461 and a cutting portion 462. The cutting portion 462 includes an undulating cutting surface 463. In this embodiment, the cutting portion 462 includes a cutting tip 468 and a plurality of blades 471-473 extending in a helical or spiral manner from the cutting tip 468 to the non-planar and undulating cutting surface perimeter 464. In this embodiment, the cutting portion 462 includes three spiraling blades 471-473 with helical-shaped valleys 481-483 disposed between the blades. As compared with the embodiments previously described, the blades 471-473 include a curved cutting face and curved cutting edge.

Like inserts 60, 100, inserts 200, 300, 400, can be employed in three cone bits like bit 30 of FIG. 1 (most preferably in an inner row or a gage row) or can be used in a single-core bits such as bit 500 of FIG. 14.

Figure 15:
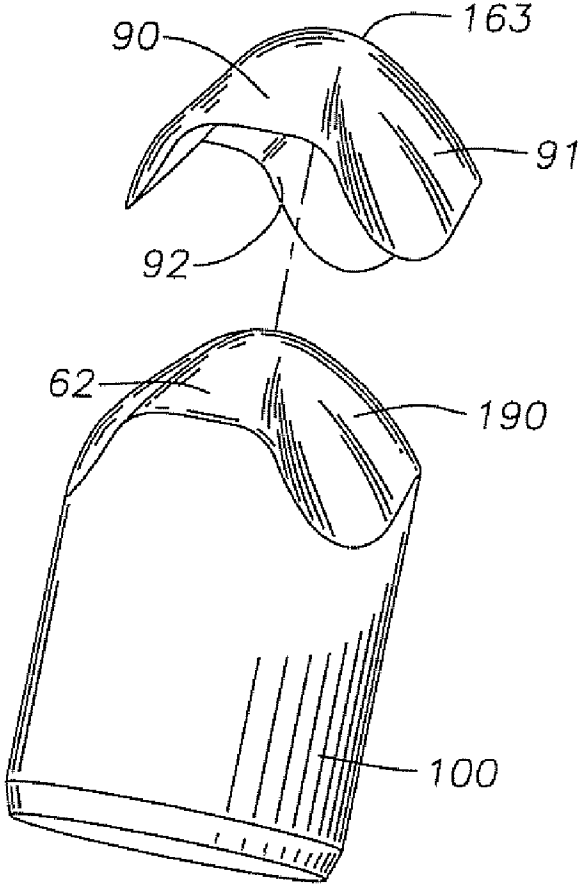
FIG. 15 is an exploded view of the insert shown in FIGS. 4-7.

Referring to FIG. 15, insert 100 and diamond layer 90 are shown in spaced-apart relationship. As previously described, diamond layer 90 covers and is attached to the carbide substrate of insert 100. Cutting portion 62 includes an interface surface 190. Diamond layer 90 includes an outer surface 91 facing the formation material, and an inner surface 92 facing the substrate interface surface 190. Diamond layer 90 is secured to interface surface 190 via conventional manufacturing techniques to form a unitary cutting insert 100. As understood from FIG. 15, the diamond layer 90 includes an undulating inner surface 92 having a shape and geometry to mate with the substrate's interface surface 190. In short, diamond inner surface 92 is the three-dimensional mirror image of substrate interface surface 190. Both inner and outer diamond surfaces 92, 91 are undulating, inner surface 92 matching the undulations of interface surface 190, while outer surface 91 forms the undulating cutting surface 163 previously described It is preferred that outer surface 91 include contours, including blades and valleys, that generally correspond in shape and position to the contours on the substrate interface surface 190.

It is to be understood that layer 90 may include a composite of multiple layers of wear-resistant materials, as well as other materials, and that it is not necessarily a single, thickness of uniform material. For example, layer 90 may include an outermost layer forming surface 91 and having a particular hardness and other characteristics, as well as one or more transition layers between the outermost layer and the substrate interface surface 190. As previously explained, such transition layers are provided to address and minimize residual stresses that can cause detrimental delamination or other failures. Likewise, although layer 90 has been referred to herein as being formed of diamond, other extremely hard and wear-resistant materials may be employed other than diamond, including polycrystalline diamond (PCD), cubic boron nitride (CBN), thermally stable diamond (TSP), polycrystalline cubic boron nitride (PCBN), and ultrahard tungsten carbide, meaning a tungsten carbide (WC) material having a wear-resistance that is greater than the wear-resistance of the material forming the substrate, as well as mixtures or combinations of these materials. As stated above, layer 90 may include multiple layers of these materials. As used in the claims herein, the term "superabrasive" shall mean and include PCD, CBN, TSP, PCBN and WC, where the WC has a wear-resistance greater than the wear-resistance of the substrate.

Referring still to FIG. 15, the thickness of diamond layer 90 ranges from about 0.010 to 0.140 inch for inserts having nominal diameters of 5/16 inch to 11/12 inch. The substrate interface surface 190 has a shape and geometry similar to that of outer surface 91 of diamond layer 90. By controlling the thickness of diamond layer 90, residual stresses are minimized to a level that permits the successful application of diamond or other superabrasive coating to a substrate interface having a peak and blades radiating therefrom.

Although in the examples above, the cutter elements 60, 100, 200, 300, 400 have been shown and described with reference to rolling cone bits, these and similar inserts can also be employed in percussion or hammer bits used to drill earthen formations. As those skilled in the drilling arts understand, such percussion bits include a drilling head at the lowermost end of the bit. A plurality of inserts 60, 100, 200, 300, 400 may be provided in the surface of the head for bearing on the rock formation being drilled. The inserts provide the drilling action by engaging and crushing rock formation on the bottom of a borehole being drilled as the rock bit strikes the rock in a percussive motion.

While preferred embodiments have been shown and described, modifications thereof can be made by one skilled in the art without departing from the spirit or teaching of this invention. The embodiments described herein are exemplary only and are not limiting. Many variations and modifications to the embodiments shown are possible and are within the scope of the invention. Accordingly, the scope of protection is not limited to the embodiments described herein, but is only limited by the claims which follow, the scope of which shall include all equivalents of the subject matter of the claims.

What is claimed is:

1. A cutter element for insertion in a drill bit comprising:

a substrate body comprising abuse portion with a central axis and a cutting portion extending from the base portion, wherein the base portion has a cylindrical outer surface disposed at a radius R relative to the central axis;

wherein the cutting portion includes an interface surface distal the base portion and a flanking surface disposed at the radius R relative to the central axis and extending from the outer surface of the base to the interface surface, wherein the flanking surface intersects the interface surface at an intersection that undulates about the circumference of the substrate body;

wherein said interface surface includes a peak region, at least three blades radiating away from said peak region, and valleys between said blades, said peak region, said blades and said valleys forming a pattern of contours on said interface surface;

at least one layer of superabrasive material on said substrate body, said layer having an inner surface engaging said substrate interface surface and an outer surface forming a cutting surface;

wherein said cutting surface comprising blades and valleys corresponding to said contours of said interface surface;

wherein each blade extends from the peak region to the flanking surface;

wherein each blade has an axial length measured parallel to the central axis from the flanking surface to the peak region, and the superabrasive material has an axial thickness measured parallel to the central axis;

wherein the axial length of each blade is greater than the axial thickness of the superabrasive material.

2. The cutter element of claim 1, wherein the axial length of each of said blades is different.

3. The cutter element of claim 1, wherein said blades are symmetrically disposed about said central axis of said base portion.

4. The cutter element of claim 1, wherein said blades include a leading edge and a trailing edge and wherein said leading edge is sharper than said trailing edge.

5. The cutter element of claim 1, wherein said blades include a leading edge and a trailing edge and wherein said leading edge extends further from said base portion than said trailing edge.

6. The cutter element of claim 1, wherein said valleys have differing depths.

7. The cutter element of claim 1, wherein each of said blades includes a blade radius defined by a plane perpendicular to said central axis and wherein the radii of said blades are substantially the same.

8. The cutter element of claim 1, wherein each of said blades includes a blade radius defined by a plane perpendicular to said central axis and wherein the radius of at least a first of said blades differs from the radius of a second of said blades.

9. The cutter element of claim 1, wherein said peak region is offset from alignment with said central axis.

10. The cutter element of claim 1, wherein at least one of said blades forms a spiral.

11. A drill bit for drilling a borehole in earthen formations, comprising:

a bit body;

at least one rolling cone cutter mounted on said bit body and adapted for rotation about a cutter axis;

at least one cutting insert mounted in said rolling cutter, said insert comprising:

a substrate body having a central axis and comprising a grip portion and a cutting portion extending from said grip portion, wherein the base portion has a cylindrical outer surface disposed at a radius R relative to the central axis;

wherein said cutting portion comprising an interface surface distal the base grip portion and a flanking surface disposed at the radius R relative to the central axis and extending from the outer surface of the grip portion to the interface surface, wherein the flanking surface intersects the interface surface at an intersection that undulates about the circumference of the substrate body;

wherein the interface surface includes a peak region, a perimeter, and at least three blades extending from said peak region toward said perimeter and first valleys between said first blades; and a layer of superabrasive material attached to said substrate body and having a first surface facing said interface surface of said substrate and a second surface spaced from said interface surface by the thickness of said layer, said second surface including a plurality of second blades substantially aligned with said first blades, and a plurality of second valleys substantially aligned with said first valleys.

12. The drill bit of claim 11 wherein said blades extend to differing axial lengths.

13. The drill bit of claim 11 wherein at least one of said blades includes a leading edge that is sharper than its trailing edge.

14. The drill bit of claim 11 wherein at least one of said blades includes a leading edge and a trailing edge, wherein said leading edge includes an extension height that is greater than the extension height of said trailing edge.

15. The drill bit of claim 11 wherein said drill bit is a single cone bit.

16. The drill bit of claim 11 wherein said drill bit includes at least two rolling cone cutters, and wherein said cutting insert is mounted in one of said cone cutters at a position such that said cutting portion cuts the bottom of the borehole.

17. The drill bit of claim 11 further comprising a plurality of said inserts mounted in a cone cutter in a circumferential row, wherein said cutting portions of said inserts are positioned so as to be free of engagement with the sidewall of the borehole.

18. The drill bit of claim 11 wherein said substrate body is an elongate body having a longitudinal axis, and wherein said first blades include a blade radius defined by a plane perpendicular to said axis, and wherein the radius of one of said first blades differs from a radius of the second of said first blades.

19. The drill bit of claim 11 wherein said second surface is continuously contoured.

20. The drill bit of claim 11 wherein said layer of superabrasive material comprises multiple layers of materials.

21. The drill bit of claim 11 wherein said layer of superabrasive material comprises a plurality of superabrasives.

22. The drill bit of claim 11 wherein said substrate body is formed of a material having a first wear-resistance, and wherein said layer of superabrasive material comprises tungsten carbide having wear-resistance that is greater than said first wear-resistance.

23. The drill bit of claim 11 wherein the cone cutter includes a backface, a nose portion opposite the backface, and a frustoconical heel surface adjacent the backface and between the backface and the nose portion; wherein the at least one cutting insert is mounted to the cone cutter between the heel surface and the nose portion.

24. A cutter element for use in a drill bit, comprising:

a substrate portion including a base with a central axis and cylindrical outer surface disposed at a radius R, and a cutting portion extending from the base. wherein the cutting portion includes an interface surface distal the base and a plurality of flanking surfaces, each flanking surface disposed at the radius R and extending axially from the base to the interface surface;

wherein each flanking surface has a height measured axially from a reference plane perpendicular to the central axis and passing through the base to the interface surface, and wherein the height of each flanking surface varies along the circumference of the substrate;

wherein said interface surface includes peak and a plurality of blades radiating away from said peak, said peak and said blades defining undulations on said interface surface;

wherein each of said blades includes a blade axis, and wherein at least two of said blade axes are angularly spaced apart by an angle less than 180° in top view; and a superabrasive layer supported on said interface surface and having a first surface engaging said interface surface and a second surface facing away from said interface surface, said second surface comprising undulations corresponding to said undulations of said interface surface;

wherein each blade extends from the peak region to one of the plurality of flanking surface;

wherein each blade has an axial length measured parallel to the central axis from the flanking surface to the peak region, and the superabrasive material has an axial thickness measured parallel to the central axis;

wherein the axial length of each blade is greater than the axial thickness of the superabrasive material.

25. The cutter element of claim 24 wherein at least one of said blades is symmetrical about a plane containing said axis and passing longitudinally through said blade.

26. The cutter element of claim 24 wherein each of said blades includes a leading edge and a trailing edge, and wherein said leading edge of at least one of said blades has a greater extension height than said trailing edge of said blade.

27. The cutter element of claim 24 wherein each of said blades includes a leading edge and a trailing edge, and wherein said leading edge of at least one of said blades is sharper than said trailing edge of said blade.

28. The cutter element of claim 24 wherein said blades extend from said peak and form angles between each pair of adjacent blades, and wherein said angle between a first pair of said blades differs from the angle between a second pair of said blades.

29. The cutter element of claim 24 wherein each of said blades includes a blade radius defined by a plane that is perpendicular to said axis, and wherein the radius of at least a first of said blades differs from the radius of a second of said blades.

30. The cutter element of claim 24 wherein the axial length of a first of said blades is different from the axial length of a second of said blades.

31. The cutter element of claim 24 wherein said interface surface comprises an undulating perimeter at an intersection of the interface surface and the flanking surfaces, and wherein said blades extend from said peak to said perimeter.

32. The cutter element of claim 24 wherein said superabrasive layer comprises multiple layers of materials.

33. The cutter element of claim 24 wherein said superabrasive layer comprises a plurality of superabrasives.

34. A drill bit for forming a borehole in earthen formations including a sidewall and a borehole bottom, the drill bit comprising:

a bit body;

at least one rolling cone cutter mounted on said bit body and adapted for rotation about a cone axis;

a plurality of cutting inserts mounted in said cone cutter in a circumferential row, wherein each of said plurality of inserts comprises:

a substrate body including a base portion with a central axis and an outer cylindrical surface disposed at radius R, and a cutting portion extending from the base portion, the insert mounted such that said cutting portion extends from said cone cutter and engage the borehole bottom;

wherein the cutting portion includes an interface surface distal the base portion and a plurality of flanking surfaces each flanking surface disposed at the radius R and extending axially from the base portion to the interface surface;

wherein each flanking surface has a height measured axially from a reference plane perpendicular to the central axis and passing through the base to the central axis to the interface surface, and wherein the height of each flanking surface varies along the circumference of the substrate;

wherein the interface surface includes a peak, a perimeter, a plurality of blades extending from said peak to said perimeter, and valleys between said blades, wherein said peak, said blades and said valleys define an undulating interface surface;

wherein each of said blades includes a blade axis, and wherein at least two of said blade axes are angularly spaced apart by an angle less than 180° in top view; and a superabrasive layer supported by said interface surface, wherein a cutting surface of the superabrasive layer is contoured to mirror said undulations of said interface surface.

35. The drill bit of claim 34 wherein said inserts are mounted in said cone cutter such that said cutting surface of said inserts is free of engagement with the borehole sidewall.

36. The drill bit of claim 34 wherein at least one of said blades includes a leading edge and a trailing edge, and wherein said leading edge has a greater extension height than said trailing edge.

37. The drill bit of claim 34 wherein at least one of said blades includes a leading edge and a trailing edge, and wherein said leading edge is sharper than said trailing edge.

38. The drill bit of claim 34 wherein said inserts include a longitudinal axis, and wherein each of said blades includes a blade radius defined by a plane that is perpendicular to said longitudinal axis, and wherein the radius of at least a first of said blades differs from the radius of a second of said blades.

39. The drill bit of claim 34 wherein the cone cutter includes a backface, a nose portion opposite the backface, and a frustoconical heel surface adjacent the backface and between the backface and the nose portion; wherein the circumferential row of the plurality of cutting inserts is an inner row positioned between the heel surface and the nose portion.

40. The drill bit of claim 34 wherein each of said cutting inserts are mounted in said cone cutter at a position such that said cutting portion cuts the bottom of the borehole.

* * * * *